US006290214B1

(12) United States Patent
DeSouza

(10) Patent No.: US 6,290,214 B1
(45) Date of Patent: Sep. 18, 2001

(54) RAIL FENCE BRACKET

(75) Inventor: Joseph DeSouza, North Royalton, OH (US)

(73) Assignee: U.S. Fence, LLC, Middleburg Heights, OH (US)

( * ) Notice: Subject to any disclaimer, the term of this patent is extended or adjusted under 35 U.S.C. 154(b) by 0 days.

(21) Appl. No.: 09/426,335

(22) Filed: Oct. 25, 1999

(51) Int. Cl.[7] ..... E04H 17/14; E04B 1/38
(52) U.S. Cl. ..... 256/69; 256/55; 52/712
(58) Field of Search ..... 52/726.2, 712; 248/218.4, 219.1, 219.3; 256/59, 65, 69, 66, 68

(56) References Cited

U.S. PATENT DOCUMENTS

| | | | | |
|---|---|---|---|---|
| 900,545 | * | 10/1908 | Humiston | 256/65 |
| 3,256,030 | * | 6/1966 | Banse | 52/712 |
| 3,524,627 | * | 8/1970 | Boyanton et al. | 256/69 |
| 3,747,898 | * | 7/1973 | Warren | 256/59 |
| 3,989,226 | * | 11/1976 | Burgers | 256/65 |
| 4,899,991 | * | 2/1990 | Brunkan | 256/69 |
| 5,657,967 | * | 8/1997 | Patrick | 256/65 X |
| 5,735,087 | * | 4/1998 | Olden | 52/712 X |

FOREIGN PATENT DOCUMENTS

| | | | | |
|---|---|---|---|---|
| 263363 | * | 7/1964 | (AU) | 52/726.2 |
| 2259923 | * | 3/1993 | (GB) | 256/65 |
| 2279975 | * | 1/1995 | (GB) | 256/65 |

* cited by examiner

*Primary Examiner*—Lynne H. Browne
*Assistant Examiner*—Ernesto Garcia
(74) *Attorney, Agent, or Firm*—Pearne & Gordon LLP

(57) ABSTRACT

A post and rail assembly uses a channel shaped bracket to secure the rails to the post. The bracket has a channel bottom portion which is attached directly by fasteners to a flattened portion on the post and two rail ends abut each other and are received within the channel. The channel has extensions along the back vertical surface of the rails with fasteners extending through these extensions horizontally into the rail and other fasteners extend from the top and bottom flanges of the channel vertically into the rail ends which cover the fasteners holding the bracket to the post.

3 Claims, 1 Drawing Sheet

RAIL FENCE BRACKET

BACKGROUND TO THE INVENTION

This invention relates generally to fences and more particularly to a novel bracket for rail fences to provide faster, more accurate, and stronger attachment for the rails to a post.

One of the most common types of fences uses a post and rail arrangement either for the complete fence or as a basic support arrangement for more decorative design fences. The construction of these fences involves assembling a number of vertical posts usually all of the same height by embedding them in the ground or otherwise providing a firm base support. The post may be round, square, rectangular and cross-section and generally extend upward from the ground at least as high as any part of the completed fence.

The rails are then attached directly to the posts and extend horizontally between the posts and these rails may be either sufficient in number to provide the complete fencing barrier or else utilized as a support for vertical boards or pickets or other type of panels as may be desired. If it is desired that the completed fence have some sort of symmetry in appearance from each side it is common to extend rails between the sides of the post. This construction usually requires some sort of attachment bracket for each rail and also generally requires the length of the rail closely match the spacing between the post sides and therefore requires special cutting if the rails are of a standard size lumber.

The other approach is to attach the rails directly to one side of the post with nails or screws so that the rail ends overlap each another either vertically or horizontally. In order to provide sufficient areas of engagement between the rails and the posts, the posts should be either square to prevent a flat surface adjacent the rail or, if of other shape, have a space cut away to provide the necessary flat surface. In any case, the assembly of the fence requires careful measurement to ensure that all the rail to post joints are at the same height and the strength depends entirely upon the fasteners used to connect the rails to the posts.

SUMMARY OF THE INVENTION

The present invention provides a novel bracket for the attachment of rails to a side of a post which also attaches the rails directly to each other independently of their attachment to the post. The bracket is preferably preattached to the post by suitable fasteners such as nails or screws after which the two rail ends are inserted into the bracket and suitable fasteners connected through the bracket to the rail ends.

According to the preferred embodiment, the bracket takes the general form of a channel in which the bottom surface is positioned vertically against a post and fastened in place by suitable fasteners extending through the channel bottom into the post. For maximum strength, the post should have a flat surface so that several fasteners can be used in horizontally as well as vertically spaced locations to provide a tight surface abutting contact with the post along most of the extent of the channel bottom. The rails, whose ends have been previously cut to fit within the channel, are then inserted horizontally into t he channel preferably with their ends abutting or nearly so. Suitable fasteners are then inserted through openings in the top and bottom sidewalls of the channel into the ends and for still additional strength, fasteners extend from projections on the channel bottom to receive a fastener that extends into the adjacent rail. As a result, the channel connects the rails to each other independently of their connection to the post so that if the post is damaged, it is less likely that the rails will be broken apart or dislodged and the integrity of the fence structure will remain.

According to the present invention, the erection of a post and rail fence can be done quite rapidly and precisely by allowing the fence posts to be located in place by placing them in a hole in the ground, for example, and then filling in around the post while checking for vertical alignment. The precise height of the fence can then be determined by attaching the brackets at the desired height directly to the post by means of suitable fasteners extending through the channel bottom abutting the post. Thus, it is possible to first locate all of the posts and all of the brackets before any of the rails are installed. After this has been done, it is possible to accommodate any variations and post spacing by cutting rails to the exact length so they extend equidistantly into the bracket channel from each end, although some variations in rail length can be tolerated because of the bracket size.

The rails are then inserted into the channel where they are secured in place by the fasteners extending through the top and bottom channel sides and since the spacing on these channel sides for the fasteners is different on the top and bottom, the fasteners can each extend for almost the entire vertical height of the rail. At the same time, fasteners extend through the projections in the back of the bracket and serve to pull the rails into the bracket channel to abut the bottom wall. Since the rails cover the heads of the fasteners extending through the bracket and into the post, these fasteners are protected from accidental removal since it is necessary to first remove the other fasteners to allow the rail to be removed from the bracket before the bracket can be removed from the post. This arrangement also allows the exposed faces of the rails to be free of projections and fasteners.

Although this bracket is intended primarily for use with wood, it may be used with other materials such as plastic extrusions which employ fasteners such as nails, screws or bolts as desired.

DETAILED DESCRIPTION OF THE PREFERRED EMBODIMENT

Figure 2:
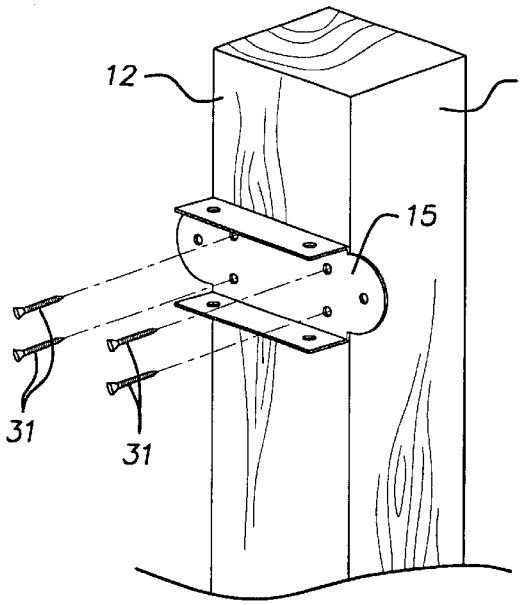
FIG. 2 is an exploded view with the fasteners removed showing a method of attachment of the bracket to a post.
Figure 3:
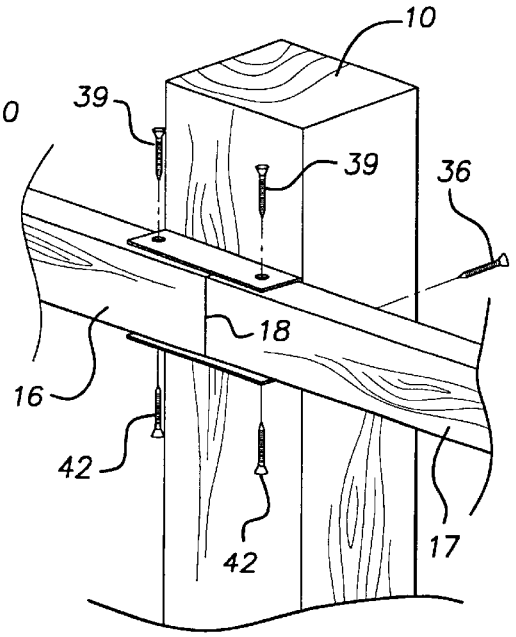
FIG. 3 shows the method of attachment of the rails to the bracket.

Referring to the drawings in greater detail, FIGS. 2 and 3 show a wooden fence post 10 which is shown as having a square cross section to provide a flat face 12 although the post can have other cross sections such as circular if it is provided with a flat face 12 as described in greater detail hereinafter. The bracket 15 of the present invention is adapted to be attached to the face 12 and receive rail end 16 and 17. These rail ends are shown as being rectangular in cross section and preferably abut or nearly abut at a gap 18 between them.

Figure 1:
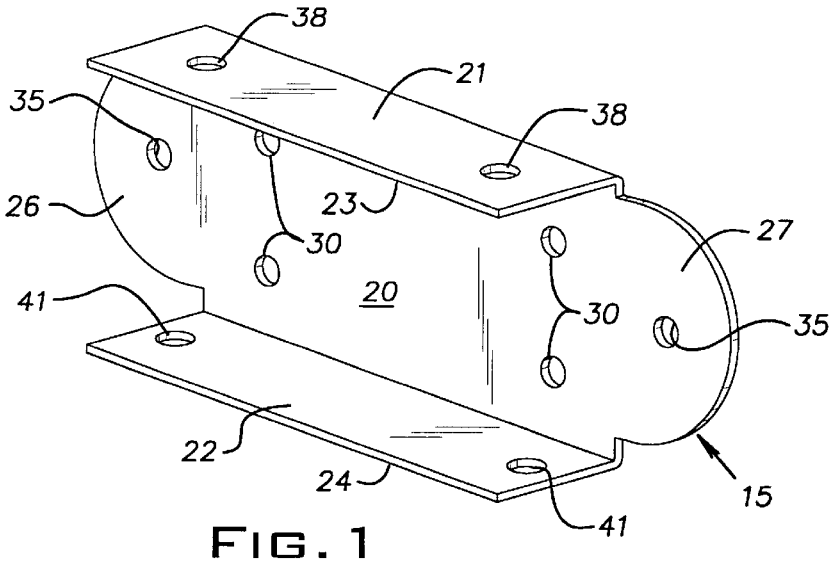
FIG. 1 is a perspective view of the bracket according to the preferred embodiment of this invention.

As best shown in FIG. 1, the bracket 15 is in the form of a channel having a bottom wall 20 which is oriented vertically in this application. Extending outward from bottom wall 20 are upper and lower side walls 21 and 22 which extend parallel to each other a spaced distance apart as determined by the vertical height of the rails 16 and 17. The side walls 21 and 22 extend outward to terminate in parallel edges 23 and 24 so that the channel has a depth equal to or less than the width or thickness of the rails to avoid projecting edges and corners.

The length of the upper and lower side walls 21 and 22 is preferably approximately equal to the width of the post face 12 to give maximum support. The bottom wall 20 has a pair of semi-circular extension portions 26 and 27 which extend outward from the bottom wall 20 and beyond the edges of the post face 12.

The bottom wall 20 of the bracket is provided with a plurality of holes 30, preferably four in number, and these holes 30 are aligned with the post face 12 and receive suitable crews or other fasteners 31 which serve to hold the bracket to the post. After the bracket has been securely fastened to the post, the rail ends 16 and 17 are placed in the channel. As shown in FIG. 1, the extension portions 26 and 27 each have a fastener hole 35 to receive a screw 36 extending from the back to initially hold the rail ends in place and ensure that they abut the bottom wall 20. As shown in FIG. 1, there are a pair of holes 38 in the upper side wall 20 and another pair of holes 41 in the lower side wall 22 with different spacing so that opposing holes are not in horizontal alignment. As shown in FIG. 1, the holes 38 are spaced more closely together than the holes 41 and each of these sets of holes 38 and 41 receive screws 39 and 42, respectively to more securely hold the rail ends within the bracket. Because of the different spacing of the hole 38 and 41, the screws 39 and 42 will extend parallel to each other, and therefore for maximum strength may be made nearly as long as the vertical spacing between the walls 20 and 21.

With this arrangement, it can be seen that the bracket of this invention allows rapid assembly to a post and rails and by providing separate fasteners to hold the bracket to the post from those securing the rail ends to the bracket, maximum strength is obtained. Furthermore, since the rail ends cover the heads of the screws 31 holding the bracket to the fence, it is necessary to remove all of the other screws 36, 39 and 42 and then to remove the rail ends before the screws 31 can be removed to allow removal and/or replacement of the bracket 15 on the post 10. Also, there are no screw heads on the front sides of the rails.

The bracket can be made of different materials such as galvanized sheet steel which has a good combination of strength, durability and low cost. They also could be made of other sheet metal such as aluminum, brass or copper or even stainless steel. It also could be made from non-metallic materials such as polyvinyl chloride which is easily extruded in a channel shape. Of course, other plastic and non-metallic materials can also be used if they provide sufficient rigidity strength and durability for the purpose.

Although the preferred embodiment of the invention has been shown and described, it is recognized that other modifications and rearrangements may be resorted to without departing from the scope with the invention as defined in the claims.

What is claimed is:

1. A post and rail fence assembly comprising a vertical post having a planar portion, a bracket formed from sheet material secured to said planar portion, said bracket having the form of a channel with a bottom wall extending generally vertically in abutting contact with said post planar portion, fastener means extending through said bottom wall into said post to secure said bracket to said post, said bracket having upper and lower side walls extending horizontally from upper and lower edges, respectively, of said bottom wall and parallel to each other a spaced distance apart, said upper and lower side walls having a length substantially equal to a length of said bottom wall, first and second rail members each having a generally rectangular end, each said end being abuttinqly received within said channel, generally vertical fasteners extending, each respectively, through said upper and lower side walls into a respective rail end, said bracket bottom wall having first and second extension portions extending beyond said post planar portion along said first and second rail members, respectively, and generally horizontal fasteners extending, each respectively, through each of said extension portions into said rail members.

2. A post and rail fence assembly as set forth in claim 1, wherein said vertical fasteners extending through said upper and lower side walls are not in alignment.

3. A post and rail fence assembly as set forth in claim 1, wherein said bracket side walls have a width less than the width of the rail members.

* * * * *